United States Patent [19]

Armell et al.

[11] Patent Number: 4,619,322

[45] Date of Patent: Oct. 28, 1986

[54] CENTRALIZING DEVICES FOR USE DOWN-WELL

[75] Inventors: Richard A. Armell; Andrew Scott, both of Montrose, Scotland

[73] Assignee: Drexel Equipment (UK) Limited, London, England

[21] Appl. No.: 669,785

[22] Filed: Nov. 9, 1984

[30] Foreign Application Priority Data

Feb. 10, 1984 [GB] United Kingdom ..... 8403600
Jul. 17, 1984 [GB] United Kingdom ..... 8418211

[51] Int. Cl.[4] ..... E21B 17/10
[52] U.S. Cl. ..... 166/241; 175/325
[58] Field of Search ..... 166/138, 172, 241; 175/325; 308/4 A; 33/178 F

[56] References Cited

U.S. PATENT DOCUMENTS 1,898,074 2/1933 Bailey ..... 166/241
2,030,244 2/1936 Cox ..... 33/178 F
3,092,182 6/1963 Blagg ..... 166/241
4,228,593 10/1980 Frank et al. ..... 33/178 F
4,243,099 1/1981 Rodgers, Jr. ..... 166/241
4,523,640 6/1985 Wilson et al. ..... 166/241

*Primary Examiner*—Stephen J. Novosad
*Assistant Examiner*—William P. Neuder
*Attorney, Agent, or Firm*—Leydig, Voit & Mayer

[57] ABSTRACT

A centralizing device for use down-well in maintaining an operational tool in a location accurately centralized in relation to the axis of the bore-hole irrespective of the angular orientation of the device and associated tool. The device comprises a shaft and at least three two-armed linkages angularly biased at their common axes towards the wall of the bore-hole by arrays of springs acting through slide blocks on the shaft. Axial movement of the blocks is limited by a central collar secured to the shaft.

3 Claims, 8 Drawing Figures

CENTRALIZING DEVICES FOR USE DOWN-WELL

BACKGROUND OF THE INVENTION

1. Field of the Invention

This invention relates to centralizing devices for use down-well.

2. Summary of the Prior Art

In down-well operations in the oil and gas production industries, it is frequently a requirement that a tool, such as a location sensor, shall be accurately centralized within the casing pipe and this has become even more important in the case of location sensors which in themselves now have an exceptionally high accuracy. Such high accuracy is of little value if the precise location becomes indeterminate because of a non-central location of the sensor within the casing pipe.

Again, the precision of centralization becomes far more important in directional drilling which may involve directions from vertical substantially to horizontal in the same casing pipe, and it has been found that known centralizers are not successful at maintaining centralization, particularly in substantially horizontal bore holes. Furthermore, some sensing units have a considerable length and may weigh over 100 kg.

The amount of support required for such sensing units as a horizontal orientation is approached can be substantial and this support must be provided irrespective of the angular location of the sensing unit relative to the casing pipe.

One object of the present inventin is to provide a centralizing device which enables precise centralizing under all operational orientations.

SUMMARY OF THE INVENTION

According to the present invention there is provided a centralizing device for use down-well in maintaining a sensor or other operational tool in a location accurately centralized in relation to the axis of the bore-hole irrespective of the angular orientation of the device and associated tool, said device comprising an elongate member, at least three, two-arm, linkages, carried as an array on the elongate member, two collars spaced on and in axial moving relationship with the elongate member, each arm of each linkage being pivoted to the other arm of that linkage at a location spaced from the elongate member and being pivoted at the other end to a respective one of the two collars, resilient means acting on the collars whereby to bias the arms angularly towards one another and thereby the common pivot axes of the arms away from the elongate member, and freely-rotatable members, each mounted for rotation on an axis coincident with the common pivot axis of each pair of arms, these members being arranged to contact the inside of a surrounding member within the bore hole.

DESCRIPTION OF THE PREFERRED EMBODIMENT

Figure 1:
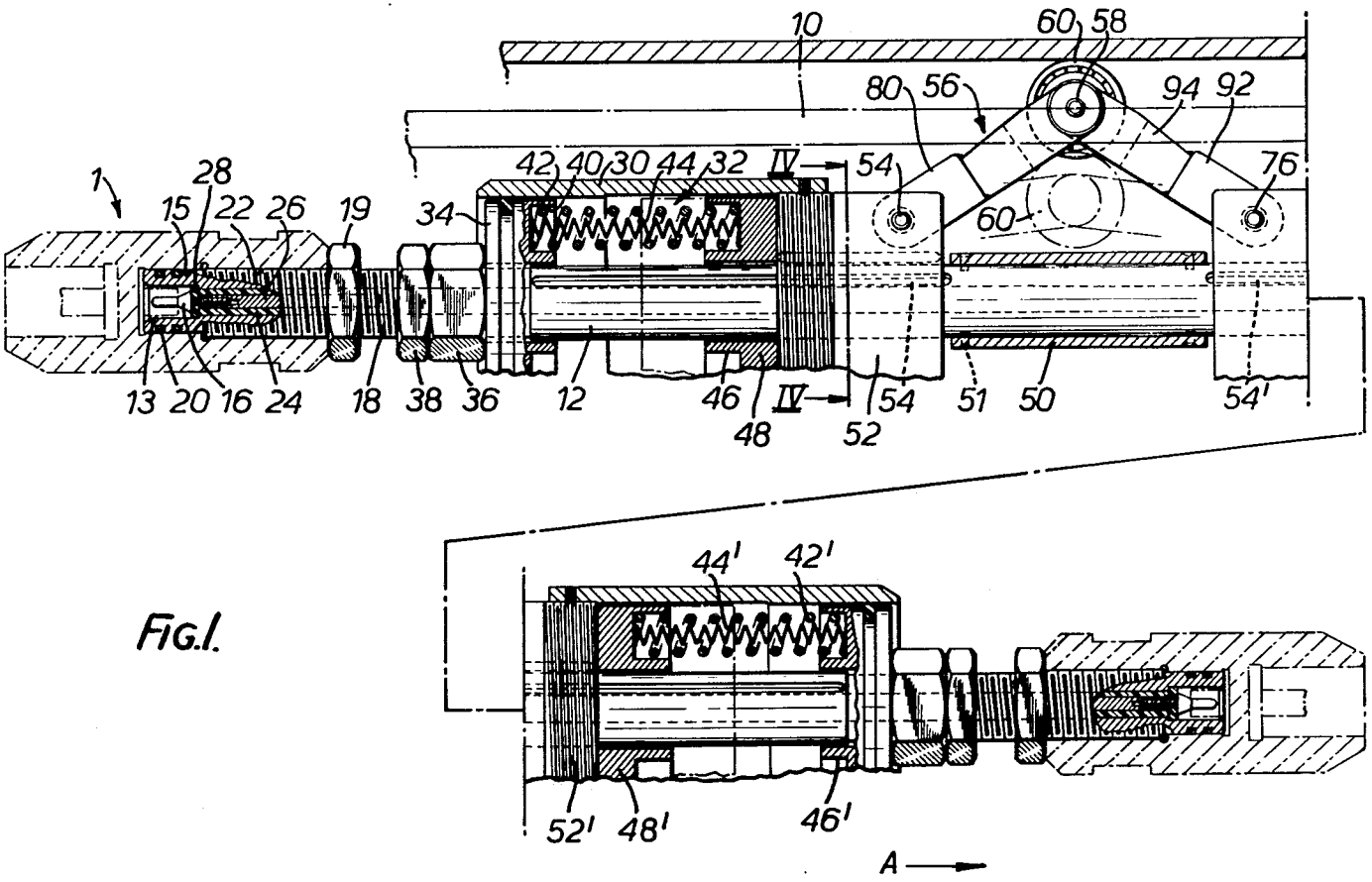
FIG. 1 is a longitudinal section illustrating a centralising device embodying the invention.

Referring now to the drawings a bore hole casing 10 (chain lines) is illustrated at a point along its length where there is a change in diameter from 7" to 9⅝" and further to identify the location illustrated an arrow A indicates the down-hole direction. The device as illustrated lies above a sensor device (gyro unit) and is identically duplicated with another centralizing device below the sensor device.

A hollow shaft or other elongate, rigid member 12 forms the basis of the tool and this is connected by a conventional crossover 11 to a wire line extending to the surface (not shown). The wire line has a central insulated wire which terminates at a female socket 13 (chain lines) which is plugged into the top banana or other jack plug similar to plug 16 within the centralizer, as shown. An extension piece 18 of the shaft 12 carries O ring seals 20 which co-operate with a bore 15 of the cross-over 11 which also has an internal, screw threaded bore 22 co-axial with bore 15 and receives an upper end portion of the extension piece 18. The piece 18 is locked to the cross-over by a lock-nut 19.

The extension piece 18 and the shaft 12 carry internally, an insulating tube 24 coaxial therewith and a central conductor 26 by which signals are transmitted to and from a gyro unit or other sensing device (not shown) secured at the lower end of the centralizer. An end insulator 28 lies between the end of the conductor 26 and the banana plug 16 itself. Although illustrated as an upper centralizing device, it will be apparent that an identical device will be used below the sensing device. Because of the mirror symmetic nature of the centralizing device the relative locations referred to herein are not of high importance and are in fact interchangeable.

Spaced by a short distance from the crossover connector 11 is a tube 30 carrying, internally, a spring unit 32 having a fixed annular abutment 34 at the lower end by which the spring unit is mounted around the shaft with the aid of a nut 36 and lock nut 38, the annular securing member 34 also carrying integrally therewith a series of cups 40 each of which supports one end portion of a helical spring 42 which is one of an array of such springs arranged around the central shaft. A secondary spring 44 of lower stiffness is mounted within each outer spring of the array.

Figure 4:
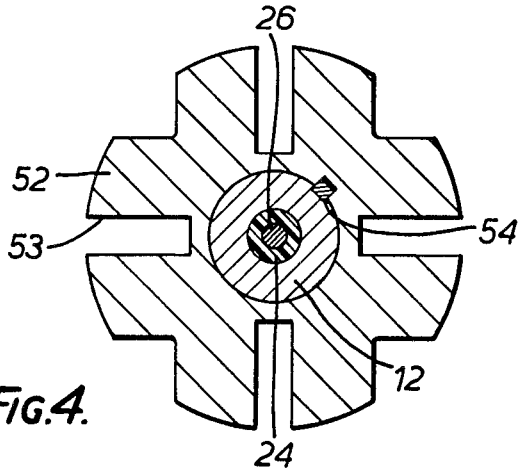
FIG. 4 is a section on the line IV—IV of FIG. 1.
Figure 5:
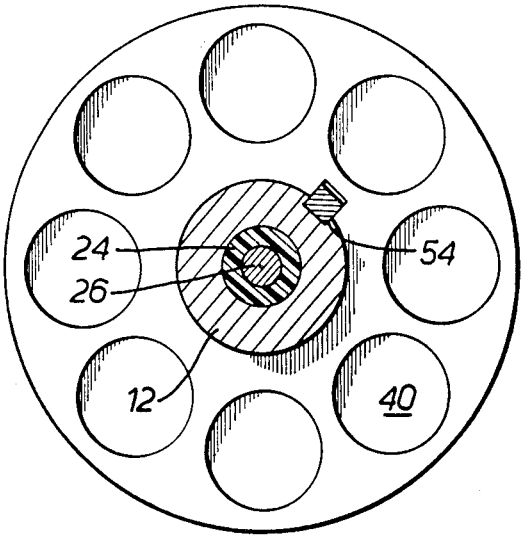
FIG. 5 is an end elevation of one of the members of the device of FIG. 1.

At the upper end (right hand end as shown) the springs 42,44 are each received in a cup 46 formed in a further annular member 48 which in this instance is slidably mounted, within limits, on the shaft and is biassed in a downwards direction by the helical compression springs 42,44. Travel of the annular member 48 is limited in the upwards direction by a sleeve 50 held by grub screws 51 to the shaft. Immediately adjacent to the annular member a slide block 52 is provided which is movable axially along the shaft and is guided thereon by a key and key-way 54, the block 52 being provided with a plurality of slots 53 (FIG. 4) each of which houses a pivot pin 54 by which one end (the upper end) of a two arm linkage 56 is pivoted to the slide block. As will be apparent the slide block 52 is continuously biassed in an upwards direction by the annular member 48 which is itself biassed by the array of the helical springs 42,44.

The two arm linkage 56 illustrated in the drawing is one of four such linkages and correspondingly the slide block 52 will have four slots and pivot pins 54. Three linkages can, alternatively, be used for smaller pipes and casing, and more than four can be used in larger pipes and casings. Each two arm linkage is pivoted together at an intermediate pivot axis 58 and on the same pivot axis an anti-friction bearing 60 having an inner and outer race is secured, the outer race acting as a roller which travels along the internal surface of the casing pipe or other lining of a bore hole. As will be apparent from the chain line indication, the linkages 56 are movable between an inner and outer position dependant upon the diameter of the casing pipe encountered at the particular location. The slide block 52 is prevented from excessive travel by the sleeve 50 surrounding and secured to the shaft 12 and at the upper end (right hand end as shown) the sleeve lies adjacent to a second slide block 52' which is a mirror image of slide block 52. The parts associated with the slide block 52' are identical to those associated with the block 52 and are given the same reference numerals but with the addition of a prime. All the pivot pins are preferably mounted in self-lubricating bushes 76.

Figure 2:
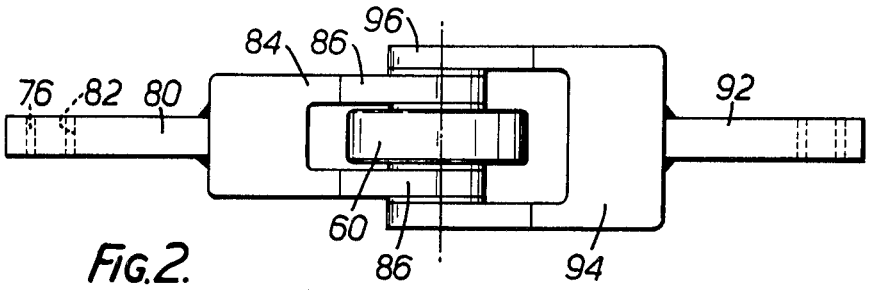
FIG. 2 is a view illustrating a detail of the device of FIG. 1.
Figure 3:
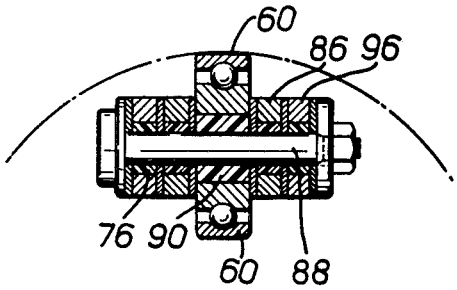
FIG. 3 is a longitudinal section of the detail illustrated in FIG. 2.

The two-arm linkage 56 will now be described in rather greater detail with reference to FIGS. 1, 2 and 3. The lower arm (left hand as illustrated) comprises a bar 80 having a pivot pin 82 aperture adjacent one end which is lined by a self-lubricating bush 76 and this bar is welded at the other end to a clevis 84, the bifurcated limbs 86 of which have bores receiving a pivot pin 88, low friction being ensured by the provision of self-lubricating bushes 76 in each limb.

The ball bearing 60 has its inner race freely rotatable upon the pivot pin with the aid of a self-lubricating bush 90 since there is no requirement that any part of the bearing shall be restrained from rotation.

The other, upper arm of each linkage similarly comprises a bar 92 with a self-lubricating bush 76 accommodated in a bore adjacent one end and at the other end is welded to a clevis 94, the limbs 96 of which are spaced by a greater distance than the limbs of the lower clevis 84. As is apparent in FIG. 3 the limbs of the upper clevis are also mounted on the pivot pin 88 through the intermediary of self-lubricating bushes 90. As will be readily appreciated the bearing arrangements ensure rotational freedom with minimum friction.

Figure 6:
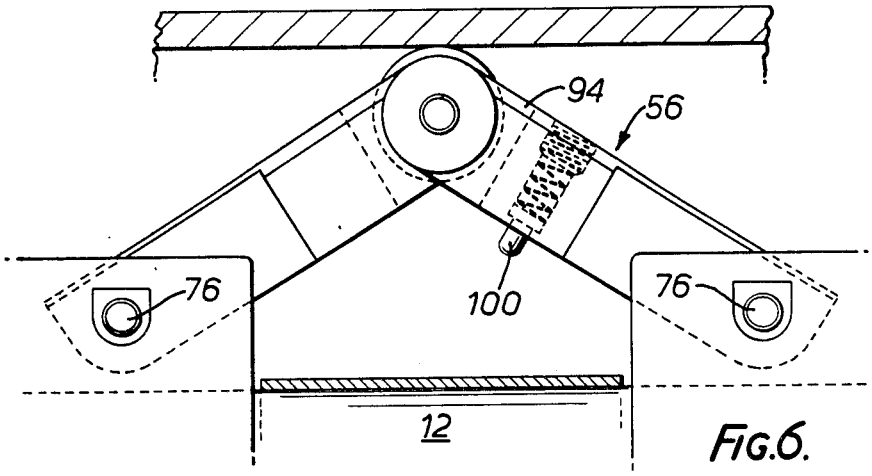
FIG. 6 illustrates a modification of one of the parts of this embodiment.

In the modification illustrated in the scrap view of FIG. 6 one arm of one of the two arm linkages is illustrated and shows a spring-loaded plunger 100 mounted in a part of the clevis of that arm. This spring-loaded plunger ensures that when the two arm linkage is in the fully retracted position there is no risk that on encountering a larger diameter bore the arms of that linkage will not remain in the same, retracted location. One or both arms of each linkage may be provided with such a plunger.

Figure 7:
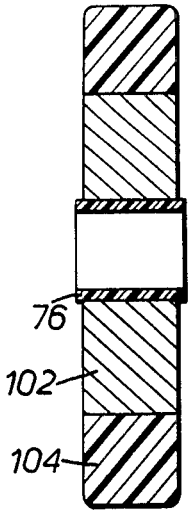
FIG. 7 illustrates a further modification of one of the parts of the embodiment of FIGS. 1 to 6.

In the modification illustrated in FIG. 7, the ball bearing of each two arm linkage 56 is replaced by a wheel 102 of steel which is bonded to a nitrile annular member 104, the steel portion being mounted for free rotation on the pivot pin with the aid of a self-lubricating OILITE (Registered Table Mark) bush 76. This modification has been found to result in reduced vibration when in use.

Figure 8:
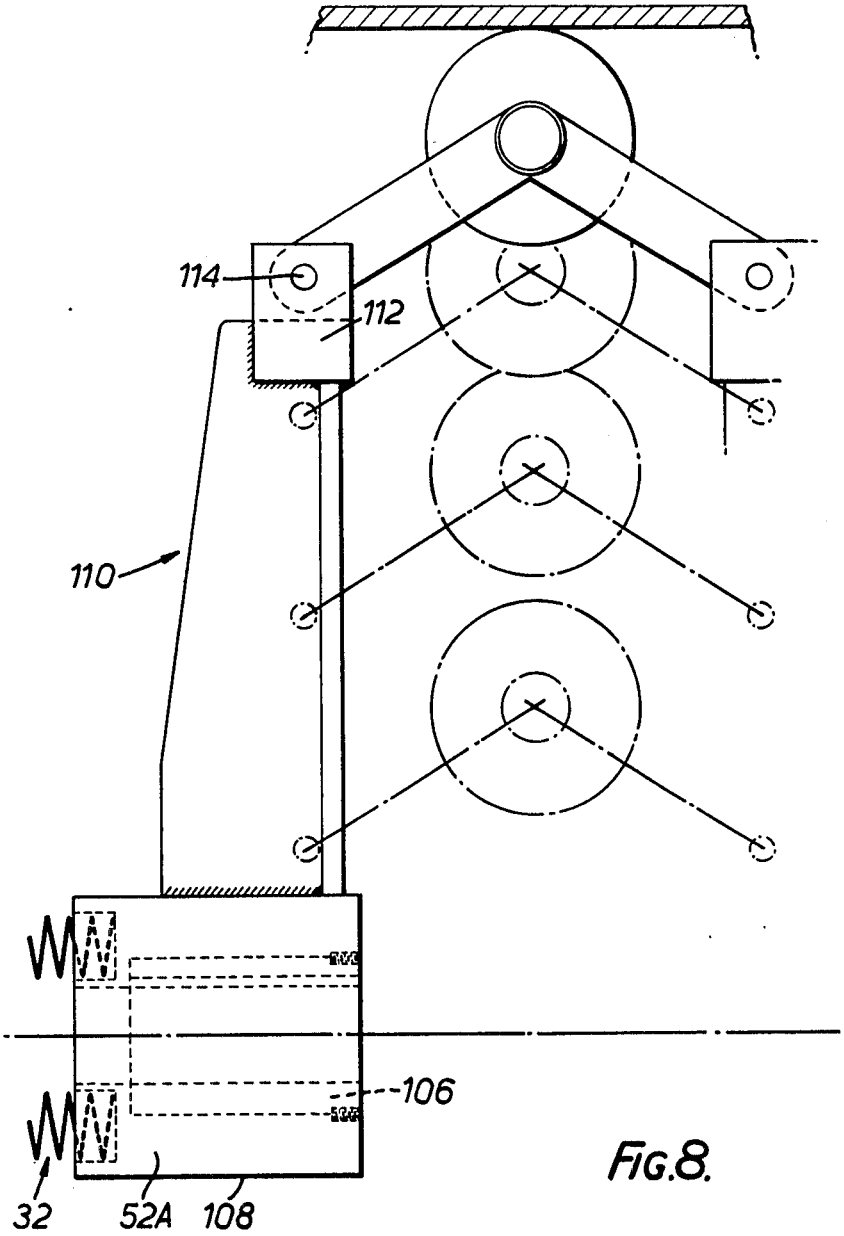
FIG. 8 illustrates a modification to another part of the embodiment of FIGS. 1 to 6, this modification serving to adapt the embodiment of FIGS. 1 to 6 for larger size pipes and casings.

Turning now to FIG. 8, the centralising device of FIGS. 1 to 6 and the modifications thereof are suitable for comparatively small size bore casings and pipes but the modification illustrated in FIG. 8 enables the device to be used for diameters up to 30" (76.2 centimeters) and various casing diameters of smaller size. In this modification the slide block 52A directly receives the array of springs 32 and has an internal bush 106 to ensure free axial sliding movement along the shaft 12.

The peripheral surface 108 of the slide block has a plurality of welded brackets 110 and at the outer end of each bracket a block 112 of U-section receives a pivot pin 114 which in turn carries the inner end of one of a two arm linkage similar to that of the main embodiment. Various possible sizes which can be accommodated are illustrated in FIG. 8.

The gyro unit (not shown) may have a diameter of 2½" a length of 14'0" and may weigh approximately 125 kg. Centralization of the gyro unit is ensured by a second centralizer which is effectively identical to the centralizer illustrated but lies further down the bore hole.

In use the giro unit is maintained centralized despite deviations from the vertical of the bore hole and hence of the casing pipe and even changes in diameter of the bore hole will not adversely affect the centralizing capability provided the changes are within predetermined limits. It will be understood that as the bore hole progressively changes from a vertical or near vertical orientation one or two of the link assemblies will be required to support and centralize the full weight of the gyro or other sensing unit connected between the upper and lower centralizers. The provision of the spring unit ensures that irrespective of the weight component which has to be supported by the centralizers the amount of force available is sufficient, and the provision of a minimum of three linkages in the array ensures that the spring support cannot over compensate for the weight component.

We claim:

1. A centralizing device for use down-well in maintaining a sensor or other operational tool in a location accurately centralized in relation to the axis of the bore hole, irrespective of the angular orientation of the device and associated tool, said device comprising an elongate member, at least three, two-arm, linkages, carried as an array on the elongate member, two collars mounted on and in axial moving relationship with the elongate member, each arm of each linkage being pivoted to the other arm of that linkage at a location spaced from the elongate member and being pivoted at the other end to a respective one of the two collars, resilient means, distinct from the arms themselves, acting on the collars whereby to bias the arms angularly towards one another and thereby the common pivot axis of the arms away from the elongate member, and a plurality of wheels, each mounted for rotation on an axis coincident with the common pivot axis of each pair of arms, these wheels being arranged to contact the inside of a surrounding member within the bore hole and comprising a self-lubricating bearing bush a steel core, and an outer annulus of nitrile.

2. A centralizing device for use down-well in maintaining a sensor or other operational tool in a location accurately centralized in relation to the axis of the bore hole irrespective of the angular orientation of the device and associated tool, said device comprising an elongate shaft, at least three, two-arm, linkages, slidably supported on the shaft, two slide blocks slidably mounted on the shaft, each arm of each linkage being pivoted, on an axis extending normal to the shaft axis, to the other arm of that linkage at a location spaced from the shaft and each arm being pivoted at the other end to respective one of the two slide blocks, compression spring arrays, each spring being of helical form, and an annular member fixed to the shaft, the springs being mounted between said annular member and a said slide block, one compression spring array acting on each slide block to bias the arms towards one another and thereby the common pivot axes of the arms away from the shaft, means, intermediate the blocks serving to limit the approach to one another of the slide blocks, and freely-rotatable members, each mounted for rotation on an axis coincident with the common pivot axis of one pair of said arms.

3. A centralizing device for use down-well in maintaining a sensor or other operational tool in the location accurately centralized in relation to the axis of the bore hole irrespective of the angular orientation of the device and associated tool, said device comprising an elongate member, at least three, two-arm, linkages, carried as an array on the elongate member, one arm of each two-arm linkage incorporating a spring-loaded plunger operative to prevent jamming of the two-arm linkage in a location with the arms lying adjacent to the shaft or other elongate member, two collars mounted on and in axial moving relationship with the elongate member, each arm of each linkage being pivoted to the other arm of that linkage at a location spaced from the elongate member and being pivoted at the other end to a respective one of the two collars, resilient means, distinct from the arms themselves, acting on the collars whereby to bias the arms angularly towards one another and thereby the common pivot axes of the arms away from the elongate member, and freely-rotatable members, each mounted for rotation on an axis coincident with a common pivot axis of each pair of arms, these members being arranged to contact the inside of the surrounding member within the bore hole.

* * * * *